US006905359B2

(12) United States Patent
Perkins

(10) Patent No.: US 6,905,359 B2
(45) Date of Patent: Jun. 14, 2005

(54) RJ-TYPE MODULAR CONNECTOR SPEED CRIMP

(76) Inventor: Daniel M. Perkins, 1608 Curlew Ct., Chesapeake, VA (US) 23321

( * ) Notice: Subject to any disclaimer, the term of this patent is extended or adjusted under 35 U.S.C. 154(b) by 0 days.

(21) Appl. No.: 10/767,636

(22) Filed: Jan. 29, 2004

(65) Prior Publication Data

US 2004/0185704 A1 Sep. 23, 2004

Related U.S. Application Data

(60) Provisional application No. 60/443,333, filed on Jan. 29, 2003.

(51) Int. Cl.[7] ..... H01R 4/24
(52) U.S. Cl. ..... 439/418; 29/866
(58) Field of Search ..... 439/418, 425, 439/403; 29/867, 866, 865, 753

(56) References Cited

U.S. PATENT DOCUMENTS

| | | | | | |
|---|---|---|---|---|---|
| 3,909,935 | A | * | 10/1975 | Aldridge et al. | 29/866 |
| 4,607,905 | A | * | 8/1986 | Vaden | 439/676 |
| 4,950,176 | A | * | 8/1990 | Cocco et al. | 439/344 |
| 5,538,438 | A | | 7/1996 | Orlando | |
| 5,785,551 | A | * | 7/1998 | Libby | 439/535 |
| 6,283,768 | B1 | | 9/2001 | VanNaarden | |
| 6,283,796 | B1 | | 9/2001 | Yeh | |
| 6,319,070 | B1 | | 11/2001 | Tan | |
| 6,402,559 | B1 | * | 6/2002 | Marowsky et al. | 439/676 |
| 6,409,535 | B1 | * | 6/2002 | Marowsky et al. | 439/418 |
| 6,416,364 | B1 | | 7/2002 | Shi | |
| 6,558,203 | B2 | | 5/2003 | Pocrass | |
| 6,558,204 | B1 | * | 5/2003 | Weatherley | 439/676 |
| 6,561,838 | B1 | * | 5/2003 | Blichfeldt | 439/418 |
| 6,565,391 | B2 | | 5/2003 | Bernstein | |
| 6,595,805 | B2 | | 7/2003 | Pocrass | |
| 6,663,419 | B2 | * | 12/2003 | Vaden | 439/502 |
| 6,729,901 | B2 | * | 5/2004 | Aekins | 439/418 |
| 6,783,402 | B2 | * | 8/2004 | Chen | 439/676 |

* cited by examiner

*Primary Examiner*—Gary F. Paumen
(74) *Attorney, Agent, or Firm*—Kimberly A. Chasteen

(57) ABSTRACT

An RJ-type connector provides simple connection to a wire or cable. The connector consists of a standard RJ-type connector shell which has a hollow interior, an open end and a substantially closed end. One or more feed-through holes is created longitudinally through the shell extending from the open end to the closed end so that a wire may pass through the opening. The feed through holes are generally parallel to each other and may be formed in the same horizontal plane or in different planes. The holes are preferably D-shaped and may be sized to accept either insulated wires or stripped wires. If insulated wires are used, the connector provides the added benefit of confirming that multiple wires have been placed in the proper configuration. The shell further includes a conductive attachment element disposed adjacent to each feed-through holes. The conductive attachment element includes a cutting leg. Crimping causes each of the cutting legs to cut the wire passing through the adjacent feed-through hole and creates an electrical connection between the wire and the conductive attachment element.

14 Claims, 5 Drawing Sheets

RJ-TYPE MODULAR CONNECTOR SPEED CRIMP

CROSS REFERENCE TO RELATED APPLICATIONS

The present application claims priority from U.S. Provisional Application Ser. No. 60/443,333, filed Jan. 29, 2003.

FIELD OF THE INVENTION

The invention relates generally to RJ-type connectors for terminating voice and data communications conductors. More particularly, the invention is directed to an RJ-type connector which can easily be connected to wires or cables.

DESCRIPTION OF RELATED ART

RJ-type connectors are industry standards for connection of voice and data communication conductors. The standard form of these connectors, however, suffers from a number of flaws. First, standard connectors require that the conducting wires and the jacket that bundles them be stripped and cut to specific lengths prior to crimping. The specific lengths are required to allow proper connections of the conductive pins as well as to utilize the full potential of the cable strain relief. This is difficult for nonprofessionals and generally requires expensive equipment. Second, because the individual wires are small and colors widely vary by manufacturer, it is difficult to determine if they have been placed into the connector in the proper order, particularly with the larger connectors comprising 8 or more individual wires to be inserted. Unfortunately, modifications of the connectors that change the dimensions of the connectors themselves are impractical. The external dimensions of the various connectors are federally regulated (See 47 CFR Part 68.500 (1998)), and the connectors are, in any event, so widely used that improvements that do not function seamlessly with legacy equipment will be essentially unusable.

Several RJ connectors have been patented. U.S. Pat. No. 6,283,768 to Van Naarden is an improved RJ-45 type plug for unshielded twisted pair (UTP) cable. This plug involves a complicated multi-element construction process. The UTP cable is stripped and divided into the four pairs of wire. Each pair is fed through a specific hole on a wire mounting block in a specific order. Then the pairs are untwisted and fit through grooves, again in a specific order. Then the wire mounting block is installed in the plug casing.

U.S. Pat. Nos. 6,595,805 and 6,558,203 to Pocrass are improved RJ type plugs and receptacles in which the contact between the receptacle and plug is improved.

The present invention addresses one or more of the above shortcomings of standard RJ-type connectors without compromising the standard configuration requirements that are necessary for proper function of the connectors with existing equipment. An RJ-type connector is provided in which individual wires can be passed completely through the connector, such that the proper ordering of the wires in the connector can be verified and the cable jacket will be properly seated. Using a current industry standard crimping tool, the wires are then crimped to establish an electrical connection and simultaneously cut to an appropriate length by means of a wire cutting leg disposed at the leading edge of the conductive attachment element disposed adjacent to each wire.

Accordingly, an object of the present invention is to provide a method for attaching an RJ-type connector to a plurality of wires such that the proper placement and order of each wire can be easily verified.

Another object of the present invention is to provide an RJ-type connector which simplifies and speeds the process of crimping the wires to be inserted into the RJ-type connector.

A further object of the present invention is to provide simplified RJ-type connectors which can be connected to wires without the use of specialized equipment.

It is another object of the present invention to provide an RJ-type connector which is convenient and easy to use.

Finally, it is an object of the present invention to accomplish the foregoing objectives in a simple and cost effective manner.

Additional objects and advantages of embodiments of the invention will be set forth in part in the description which follows, and in part will be obvious from the description, or may be learned by practice of the invention. The objects and advantages of the invention will be obtained by means of instrumentalities in combinations particularly pointed out in the appended claims.

SUMMARY OF THE INVENTION

An RJ-type connector provides simple connection to a wire or cable. The connector consists of a standard RJ-type connector shell which has a hollow interior, an open end and a substantially closed end. One or more feed-through holes is created longitudinally through the shell extending from the open end to the closed end so that a wire may pass through the opening. The feed through holes are generally parallel to each other and may be formed in the same horizontal plane or in different planes. The holes are preferably D-shaped and may be sized to accepted either insulated wires or stripped wires. If insulated wires are used, the connector provides the added benefit of confirming that multiple wires have been placed in the proper configuration. The shell further includes a conductive attachment element disposed adjacent to each feed-through holes. The conductive attachment element includes a cutting leg. Crimping causes each of the cutting legs to cut the wire passing through the adjacent feed-through hole and creates an electrical connection between the wire and the conductive attachment element.

A method for electrically and mechanically connecting an RJ-type connector with a wire. A standard RJ-type connector shell is provided which has a hollow interior, an open end and a substantially closed end. One or more feed-through hole is created which passes from the open end of the shell longitudinally through the shell to the closed end of the shell. A conductive attachment element, which includes a cutting leg, is disposed adjacent to each feed-through hole. A wire is threaded through each of the feed-through holes. When crimped, the cutting leg cuts the wire and creates an electrical connection between the wire and the conductive attachment element.

BRIEF DESCRIPTION OF THE DRAWINGS

FIG. 6*a* shows the connector head prior to insertion of the wires;

FIG. 6*b* shows connector head and installed wires prior to crimping.

Figure 1A:
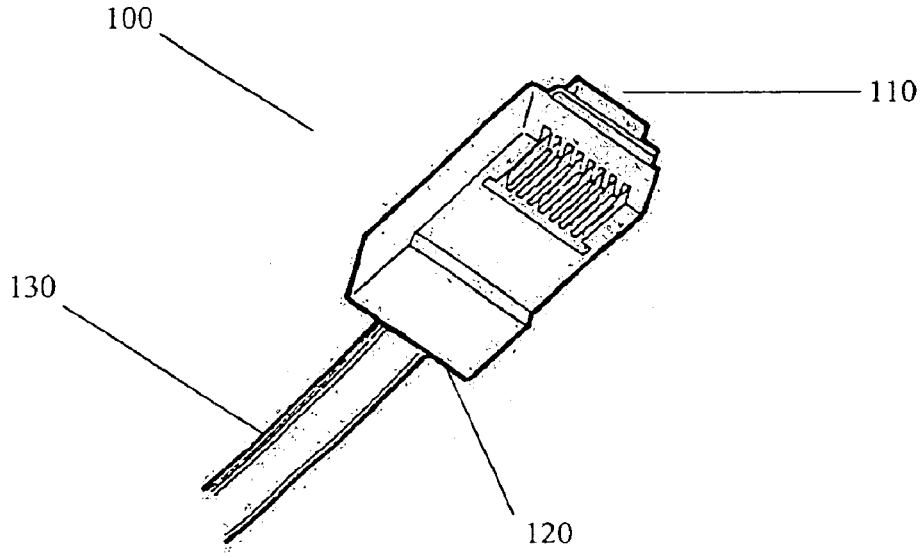
FIGS. 1*a* and 1*b* show perspective views, from above and below respectively, of a standard RJ-45 connector.

| Element List | |
|---|---|
| 100 | RJ-type connector |
| 110 | connection end of RJ-type connector |
| 120 | wire feed end of RJ-type connector |
| 130 | cable |
| 140 | wires |
| 150 | locking mechanism |
| 160 | wire feed holes |
| 210 | conductive attachment element |
| 220 | jack connection end of conductive attachment element |
| 230 | terminal lead |
| 240 | wire connection end of conductive attachment element |
| 250 | cutting leg |

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating general principles of embodiments of the invention. In particular, the RJ connector described below and shown in the drawings is an RJ-45 connector. The invention may be adapted for use with any RJ-type connector, including but not limited to RJ-11, RJ-12 and RJ-type connectors used for high-speed data. The slight modifications necessary to accommodate the different RJ-type connectors will be obvious to those of ordinary skill in the art.

Figure 1B:
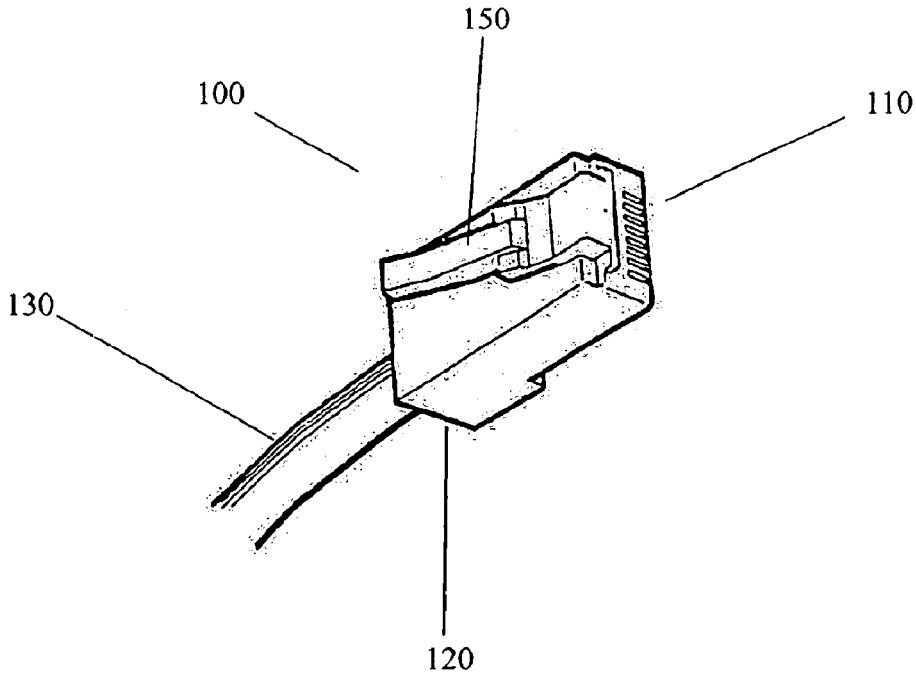

Referring now to the drawings, FIG. 1 shows a standard RJ-45 connector 100 with a cable 130 installed. As is well known in the art, RJ-type connectors 100 have an outer shell and are at least partially hollow in order to accept a round or flat cable 130 or wires 140 from a cable. The wires 140 are connected in some manner to electrical contacts within the connector 100 which contacts mate with electrical contacts in an RJ-45 jack (not shown). The connector 100 further includes a locking mechanism 150 for retaining the connector 100 within the jack. Because the Federal Communications Commission has set forth specifications for RJ-type connectors, the characteristics are standard and well known to those of ordinary skill in the art.

Figure 2:
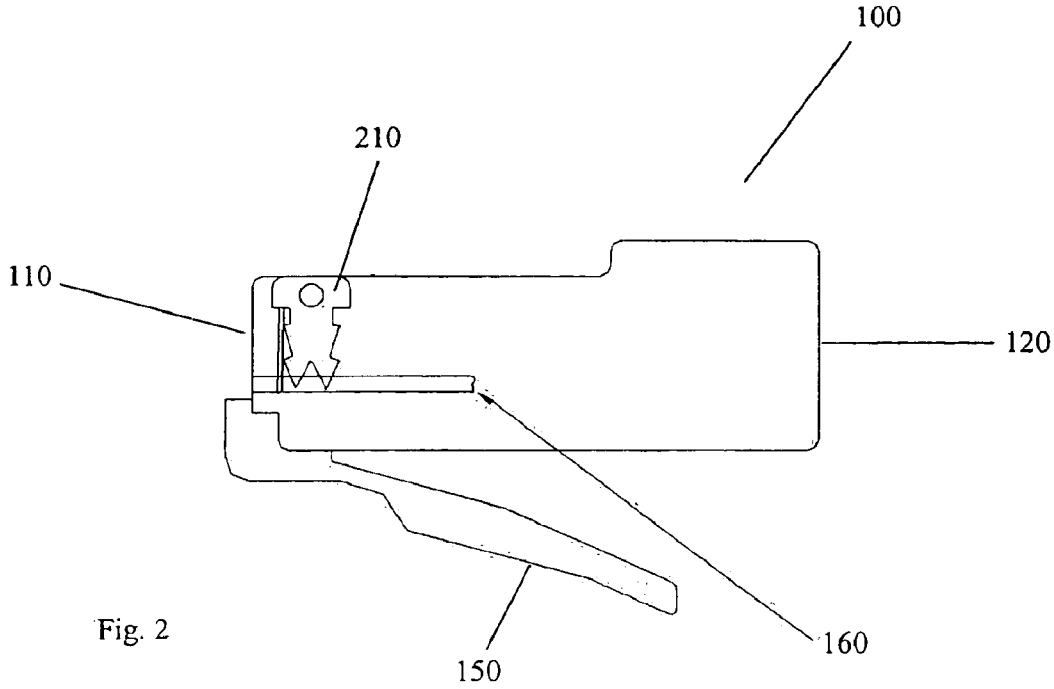
FIG. 2 shows a longitudinal side cross-sectional view of an RJ-type connector according to the preferred embodiment of the present invention.
Figure 3:
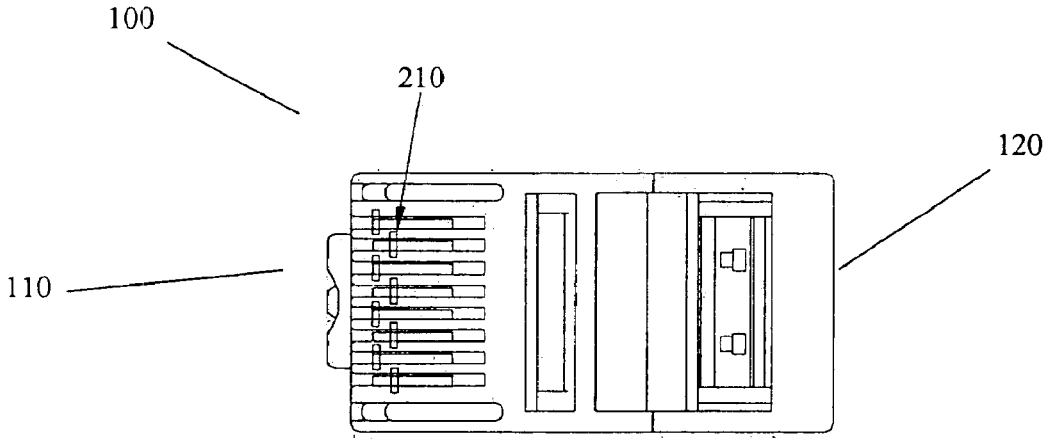
FIG. 3 shows a top view of an RJ-type connector according to the preferred embodiment of the present invention.

FIGS. 2 and 3 show an RJ-type connector 100 according to the preferred embodiment of the present invention. The connector 100 is provided with a connection end 110 and a wire feed end 120. A plurality of wire feed holes 160 extend within the connector 100 from the wire feed end 120 forward and out the connection end 110. As a result, wires 140 inserted into the wire feed holes 160 at the wire feed end 120 of the RJ-type connector 100 can be extended completely through the RJ-type connector 100 and out the connection end 110, allowing verification that each wire 140 is in the correct order and in its proper wire feed hole 160 prior to crimping. The wire feed holes 160 are preferably large enough to accept a stranded wire and are preferably D-shaped. The present invention may be used with stripped wire as well. As shown in FIGS. 5*a*, 5*b*, 5*c* and 5*d*, many different configurations exist for the wire feed holes 160.

Figure 4A:
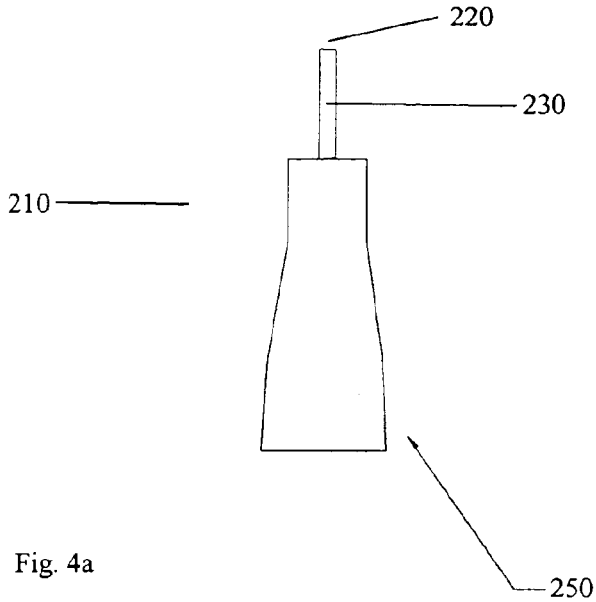
FIG. 4*a* shows a front view of a terminal connector according to the preferred embodiment of the present invention.
Figure 4B:
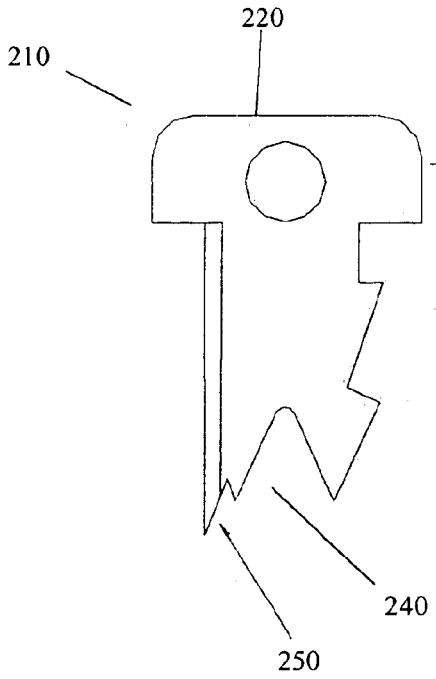
FIG. 4*b* shows a side view of a terminal connector according to the preferred embodiment of the present invention.
Figure 4C:
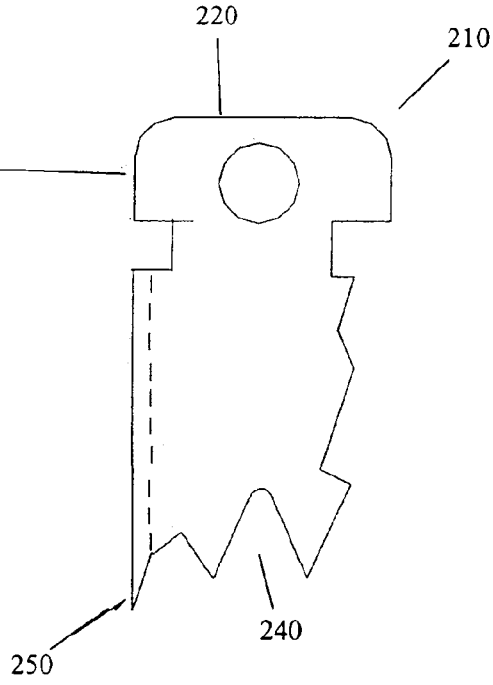
FIG. 4*c* shows a side view of a terminal connector according to an alternate embodiment of the present invention.
Figure 5A:
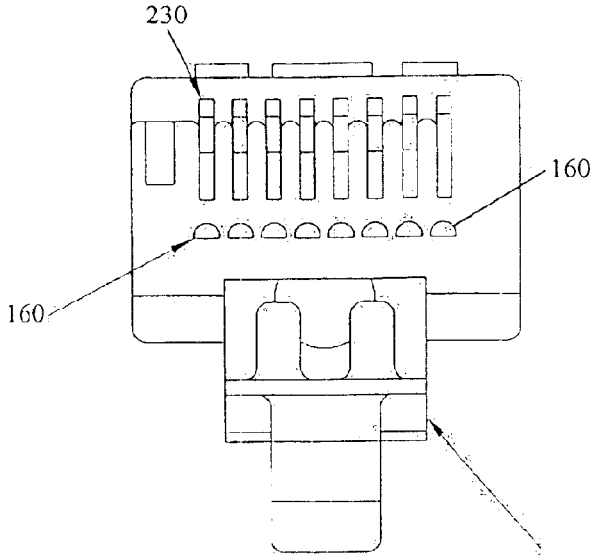
FIG. 5*a* shows a view of the RJ-type connector from the connection end according to the preferred embodiment of the present invention.
Figure 5B:
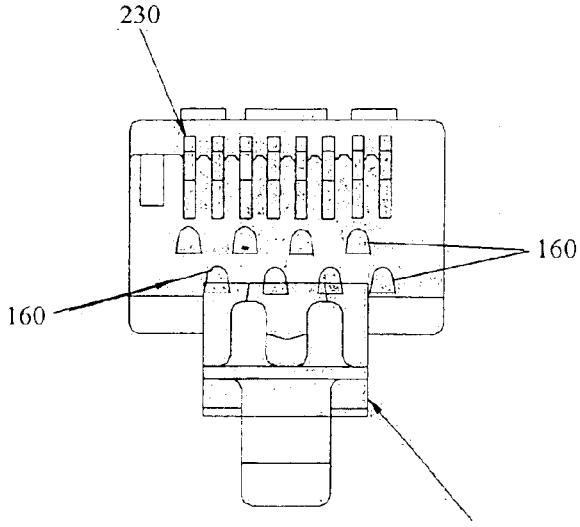
FIG. 5*b* shows a view of the RJ-type connector from the connection end according to an alternate embodiment of the present invention.
Figure 5C:
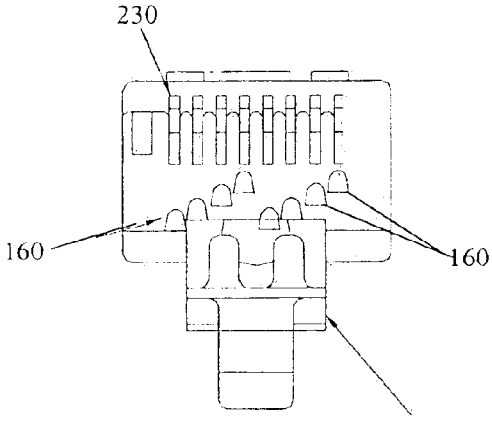
FIG. 5*c* shows a view of the RJ-type connector from the connection end according to an alternate embodiment of the present invention.
Figure 5D:
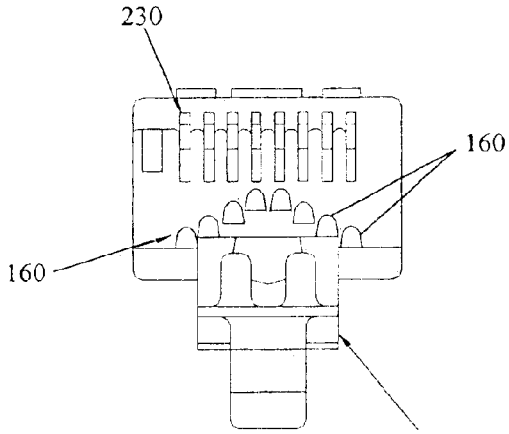
FIG. 5*d* shows a view of the RJ-type connector from the connection end according to an alternate embodiment of the present invention.

The RJ-type connector 100 is further provided with at least one conductive attachment element 210, such as an insulation displacement connector (IDC) pin, with a jack connection end 220 containing a terminal lead 230 and a wire connection end 240 as shown in FIGS. 4*a*, 4*b* and 4*c*. The wire connection end 240 of each conductive attachment element 210 is provided with a cutting leg 250, said cutting leg 250 being disposed toward the connection end 110 of the RJ-type connector 100. FIGS. 4*b* and 4*c* show alternate cutting legs 250; other designs are within the scope of this invention.

Figures 6A, 6B:
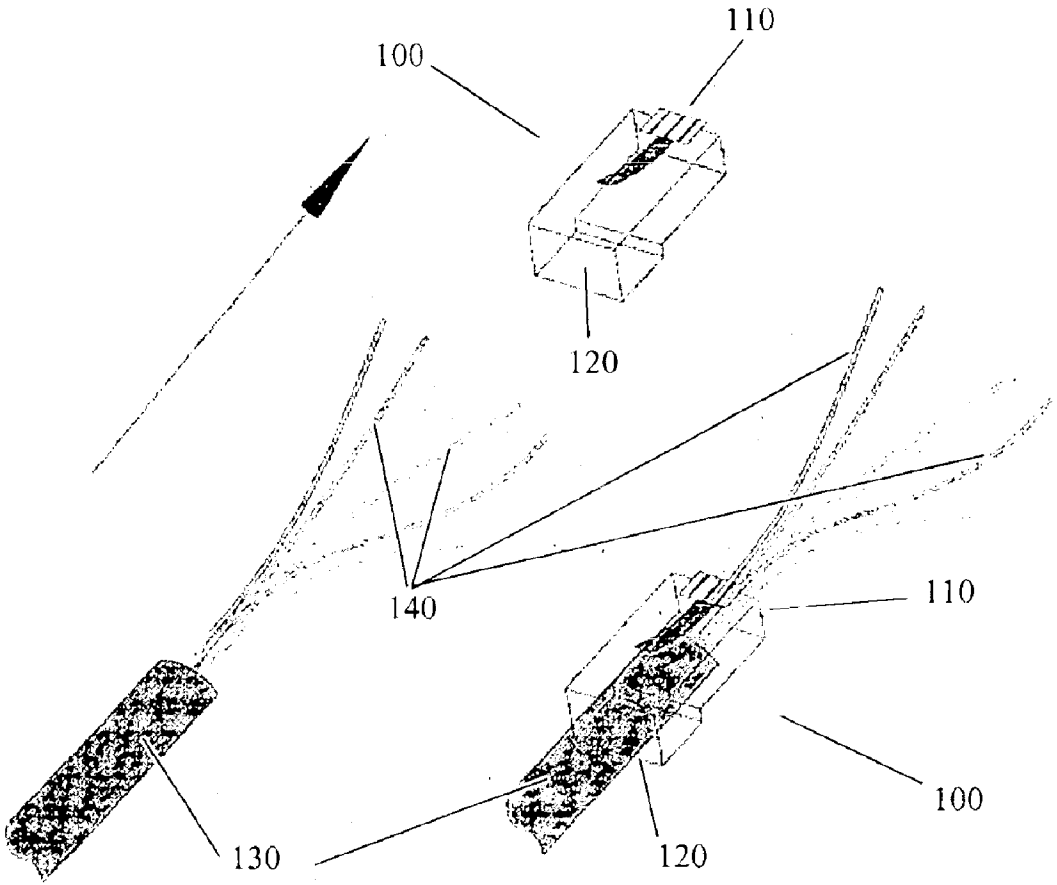
FIGS. 6*a* and 6*b* show perspective views of the construction of an RJ-type connector according to the preferred embodiment of the present invention.

After one or more wires 140 have been fed through the wire feed through holes 160 and extended out through the connection end of the wire feed through holes 160, as shown in FIG. 6, the wires 140 may be cut and electrical connection established between each terminal 230 and its corresponding wire 140 by crimping down on the terminal leads 230 of the conductive attachment elements 210, which simultaneously cuts the wires 140 to the proper length and establishes a conductive connection between each conductive attachment element 210 and its corresponding wire 140.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An RJ-type connector for connecting a cable having at least one wire to an RJ-type jack, comprising:

a shell having a hollow interior, an open end and a substantially closed end;

at least one feed-through hole passing from the open end of the shell longitudinally through the shell to the closed end of the shell, creating an opening for a wire;

at least one conductive attachment element disposed adjacent to such feed-through hole;

the conductive attachment element further comprising a cutting leg wherein, upon crimping, the cutting leg severs the wire passing through said feed-through hole to an appropriate length and creates an electrical connection between the wire and the conductive attachment element.

2. The RJ-type connector as set forth in claim 1 further comprising a plurality of feed-through holes passing from the open end of the shell longitudinally through the shell to the closed end of the shell, each hole creating an opening for a wire.

3. The RJ-type connector as set forth in claim 2 wherein the feed-through holes are substantially parallel and in the same plane.

4. The RJ-type connector as set forth in claim 2 wherein the feed-through holes are substantially parallel and in more than one plane.

5. The RJ-type connector as set forth in claim 1 wherein each of the at least one feed-through holes is D-shaped.

6. The RJ-type connector as set forth in claim 1 wherein each of the at least one feed-through holes is designed to accept insulated wires.

7. The RJ-type connector as set forth in claim 1 wherein each of the at least one feed-through holes is designed to accept stripped wires.

8. A method for electrically and mechanically connecting an RJ-type connector with a wire, the method comprising the steps of:

providing a shell having a hollow interior, an open end and a substantially closed end;

creating at least one feed-through hole passing from the open end of the shell longitudinally through the shell to the closed end of the shell;

providing a conductive attachment element disposed adjacent to each feed-through hole, the conductive attachment element further comprising a cutting leg;

threading a wire through each at least one feed-through hole;

crimping the shell such that the cutting leg severs the wire to an appropriate length and creates an electrical connection between the wire and the conductive attachment element.

9. The method as set forth in claim 8 wherein a plurality of feed-through holes passing from the open end of the shell longitudinally through the shell to the closed end of the shell is created.

10. The method as set forth in claim 9 wherein the feed-through holes are substantially parallel and in the same plane.

11. The method as set forth in claim 9 wherein the feed-through holes are substantially parallel and in more than one plane.

12. The method as set forth in claim 8 wherein each of the at least one feed-through holes is D-shaped.

13. The method as set forth in claim 8 wherein each of the at least one the feed-through holes is designed to accept insulated wires.

14. The method as set forth in claim 8 wherein each of the at least one feed-through holes is designed to accept stripped wires.

* * * * *